United States Patent [19]

Gaia

[11] 4,349,804

[45] Sep. 14, 1982

[54] FUSE ASSEMBLY FOR A MINIATURE PLUG-IN FUSE

[75] Inventor: Aldino J. Gaia, St. Louis, Mo.

[73] Assignee: McGraw-Edison, Rolling Meadows, Ill.

[21] Appl. No.: 268,233

[22] Filed: May 29, 1981

[51] Int. Cl.[3] ..... H01H 85/02

[52] U.S. Cl. ..... 337/198; 337/295

[58] Field of Search ..... 337/198, 290, 293, 295, 337/297

[56] References Cited

U.S. PATENT DOCUMENTS 3,417,357 12/1968 Withers ..... 337/295

4,023,264 5/1977 Schmidt et al. ..... 337/198

4,224,592 9/1980 Urani et al. ..... 337/198

*Primary Examiner*—George Harris

*Attorney, Agent, or Firm*—Charles W. MacKinnon; Ronald J. LaPorte; Jon C. Gealow

[57] ABSTRACT

A fuse assembly for a miniature plug-in fuse is provided with a pair of parallel spaced-apart conductive legs, each having plug-in members at one end. A fuse link of generally constant cross sectional area, integrally formed with the conductive legs, extends therebetween to form a fuse assembly of substantially planar construction. The fuse link is provided with one or more transverse offsets, each forming a weak spot.

15 Claims, 9 Drawing Figures

FUSE ASSEMBLY FOR A MINIATURE PLUG-IN FUSE

BACKGROUND OF THE INVENTION

The present invention relates to fuses of a small physical size, and more particularly, this invention relates to miniature plug-in fuses, such as those utilized in automobiles, having conductors and a fuse link stamped from the same strip of fusible metal.

DESCRIPTION OF THE PRIOR ART

To prevent undesired heating and potentially damaging and dangerous overload conditions, a fuse or fuse link is inserted in series with a conductor so that it will melt at a desired current level. Such a fuse link is usually made of a fusible metal or fusible metal alloy which has a significantly lower melting point than the copper conductors.

In general, a fuse link should be of the smallest physical size permitting required levels of current flow, while at the same time assuring interruption of the flow of electrical current when desired. Various types of fuses, including some for interrupting relatively low levels of current in relatively low voltage applications, have been used. The most prevalent types of fuses in the latter category are those having a sealed glass cylindrical envelope surrounding a fusible link which is electrically connected to the terminal connectors capping each end. This type of fuse is in common use in automobiles. Such a fuse suffers from several disadvantages. It is comparatively bulky and fragile; it is difficult to handle; and it has its terminals exposed so that undesired contact is possible.

Less bulky fuses having conductive elements formed entirely of fusible metal have been developed. The conductive elements of these fuses are partially enclosed by a plastic housing having an open end from which coplanar terminals, or plug-in connector members, extend. One type of such a fuse is disclosed in U.S. Pat. No. 4,224,592 issued to Angelo Urani and Aldino J. Gaia, and assigned to the assignee of the present invention. While such fuses are useful, there are areas in which improvement is desirable. Several drawbacks stem from the integral formation of plug-in members and fuse link, wherein the plug-in members must be of a sufficiently massive construction to provide the mechanical integrity required of the plug-in connector members. While suitable for larger amperage rated fuses, it is extremely difficult, if not impossible, to form fuse links of very small amperage ratings in such prior art fuses. To be competitively advantageous, all conductive portions of such fuses must be formed from a single piece of fusible metal, having a thickness or gauge throughout, as uniform as possible.

Portions of metal between the plug-in connector members, or legs, are punched or blanked to form one or more relatively narrow fusible members. However, due to the inherent mechanical weakness of such extremely narrow fuse links, and the inability to form a portion narrower than 0.009 inches, limitations are encountered in this method of blanking low amperage fuse links. As an alternative, portions lying between the legs may be coined or skived to reduce the gauge or thickness thereof, and hence, to reduce the thickness of the fuse link formed therefrom. However, this latter method is limited, in that commercially competitive coining or skiving manufacturing techniques are not capable of producing fuse links having sufficiently small cross-section dimensions, necessary for very low amperage fuses. Further, the fuse links that are currently being produced of the smaller ampere sizes are attached between relatively massive plug-in connector members. Such fuse constructions are less easily manufactured with modern, commercially advantageous, automated assembly methods.

SUMMARY OF THE INVENTION

With the present invention there is provided an economical miniature plug-in fuse assembly of unitary construction, having fuse links of greater mass and smaller ampere ratings that those previously achievable. A miniature plug-in fuse assembly of unitary construction is provided with a pair of electrically conductive legs, having first and second ends and a fuse link extending between second ends of those legs. The first ends of the conductive legs are formed to provide plug-in connector members which can be inserted into appropriate receptacles to provide installation of the fuse on a terminal board or the like.

The conductive legs and fuse link are formed as an integral assembly, from a single strip of fusible metal having a uniform thickness. The fuse link is elongated, and is of constant width and thickness. One or more weak spots are formed by introducing transverse offsets in the fuse link, to thereby provide a fuse having the lowest current ratings available in such fuses today, but without costly coining or skiving techniques, as are required in prior art fuses. However, by employing such skiving techniques, the transverse offset weak spot of the present invention enables fuse links to be fabricated with current ratings well below the threshold of prior art technology. Wherein the fuse link, at points immediately adjacent the weak spot, is of relatively constant width, an increased mass is provided immediately adjacent the weak spot, resulting in improved time delay operation, cycling characteristics, and ability to withstand mechanical shock during assembly of the fuse.

In manufacturing the fuse assembly, a strip of fusible metal of constant cross-sectional area is advanced through a sequence of progressive blanking operations. Conductive legs and an inner-connecting cross member are blanked from the strip. The fuse link, having one or more transverse offsets is then formed by successive blanking operations.

These and other objects, advantages and features of this invention will hereinafter appear, and for purposes of illustration, but not of limitation, exemplary embodiments of the subject invention are shown in the apended drawings.

DETAILED DESCRIPTION OF THE PREFERRED EMBODIMENT

Figure 1:
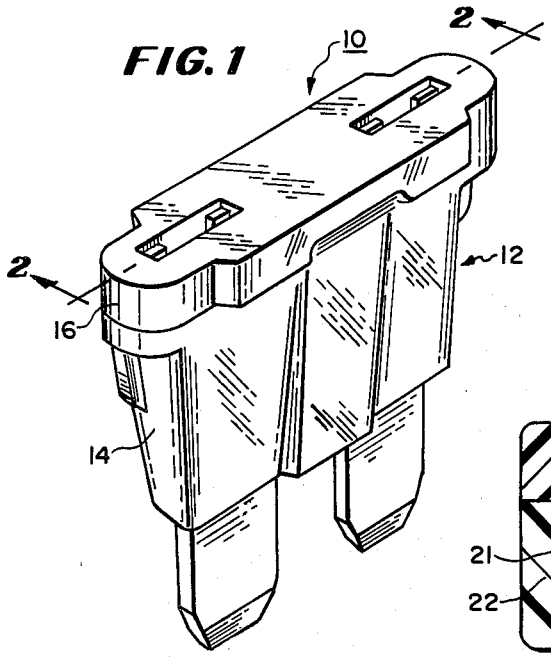
FIG. 1 is a perspective view of a miniature plug-in fuse employing the fuse assembly constructed according to this invention.
Figure 2:
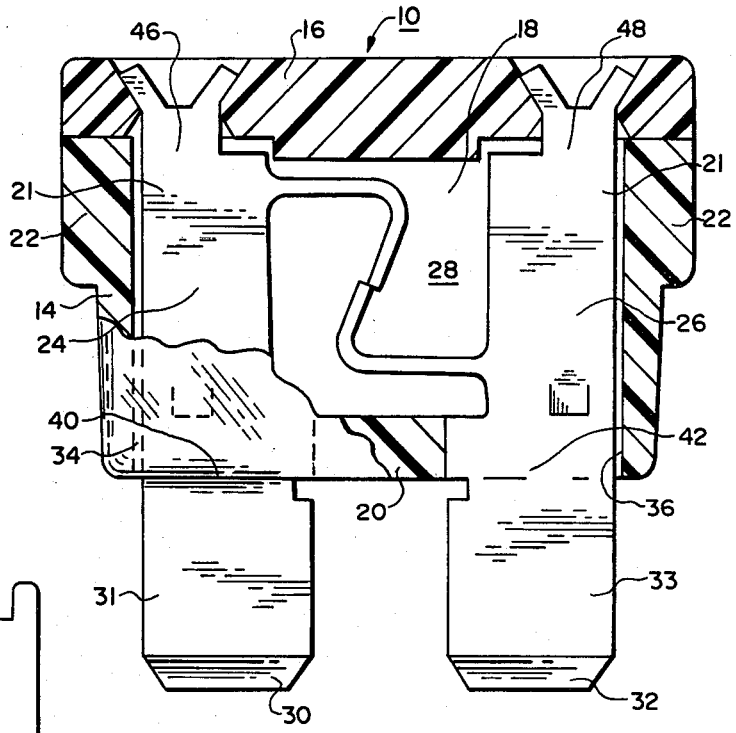
FIG. 2 is a cross sectional view taken along the line 2—2 of FIG. 1.

Referring now to FIGS. 1, and 2, a miniature plug-in fuse 10 is shown constructed according to the present invention. Assembly 10 includes a casing 12 comprising a body 14 and a cover 16, constructed of plastic according to known techniques employed in mass production of such fuses. Body 14 is hollow with an open end 18 and a substantially closed end 20. Body 14 has a generally rectangular cross-section and a thickness that is small relative to the dimensions of the cross section. Ribs are formed on body 14, imparting structural rigidity thereto, as well as providing alignment of cover 16 during automated assembly of casing 12.

An integral fuse assembly 21 comprising a pair of conductive legs 24, 26 and a fusible portion 28 is shown in FIG. 2, the assembly being stamped from a strip of fusible metal. Conductive legs 24, 26 are essentially flat, with a generally rectangular shape. Conductive legs 24, 26 include plug-in members 30, 32 formed in first ends 31, 33 thereof. Plug-in members 30, 32 extend through corresponding openings 34, 36 respectively, of casing body 14, forming an interference fit therewith. Slots or grooves 40, 42 formed in each interior side wall of casing body 14, receive the sides of conductive legs 24, 26 to support and guide the legs as they are telescopically inserted in casing body 14. Slots 40, 42 permit the use of an interference fit between conductive legs 24, 26 and the substantially closed end of casing 14, while permitting easy insertion at the open end of casing body 14. Conductive legs 24, 26 are spaced apart from each other in a generally parallel, co-planar fashion. Fusible portion 28 extends between legs 24, 26 adjacent second ends 46, 48 thereof.

Figure 3:
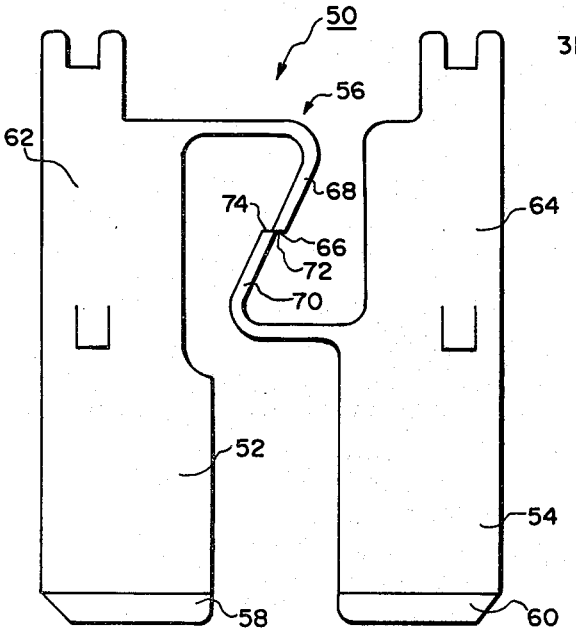
FIGS. 3–9 show vaious fuse assemblies constructed according to this invention.

Referring now to FIG. 3, an integral fuse assembly 50 of conductive legs 52, 54 and fusible portion 56, is formed from a single strip of fusible metal. Plug-in members 58, 60 are formed at first ends of legs 52, 54. Second ends 62, 64 of legs 52, 54 have a reduced width compared with the width of those legs adjacent plug-in members 58, 60. Throughout its length, fusible portion 56 has a constant width. Fusible portion 56 includes a weak spot 66 at the central portion thereof. Weak spot 66 comprises a transverse offset of strip portions 68, 70 with edge faces 72, 74, respectively thereof lying in a common plane. Strip portions 68, 70 are straight line portions extending in the same direction, having longitudinal axes generally parallel to each other. The common plane of the edge faces 72, 74 may be positioned perpendicular to the longitudinal axes of strip portions 68, 70, in which case a "zero-length" offset will be formed, having the operating advantages set forth in U.S. Pat. No. 3,417,357 to J. S. Withers, assigned to the assignee of the present invention. The fusible portion of this invention need not form a "zero-length" weak spot, i.e., the common plane of edge faces 72, 74 may be arranged obliquely to the longitudinal axes of strip portions 68, 70.

Figure 4:
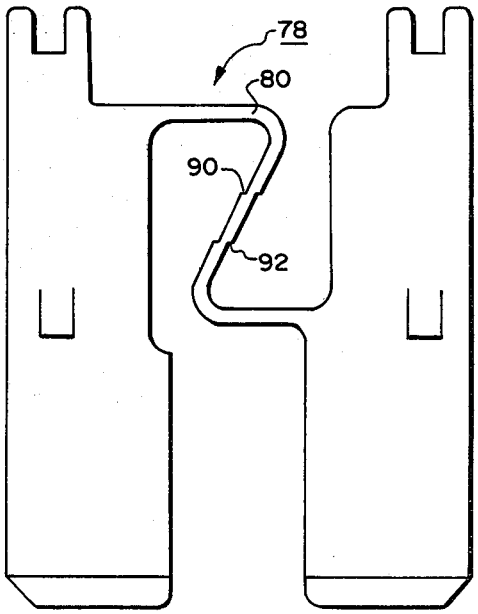
Figure 5:
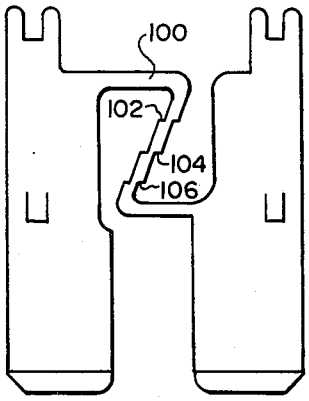
Figure 6:
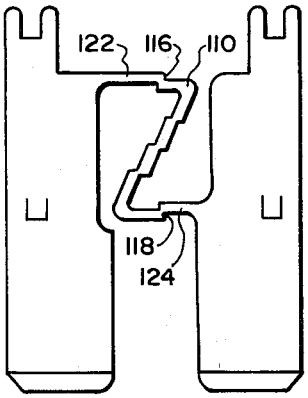

Referring now to FIG. 4, an integral fuse assembly 78 is shown, substantially similar to fuse assembly 50 of FIG. 3, except fusible portion 80 thereof has two transverse offset weak spots 90, 92. FIG. 5 shows a similar fusible portion 100, substantially identical to fusible portion 80 of the fuse of FIG. 4, except that three weak spots 102, 104, 106 are each formed by a transverse offset, as described above. A fusible portion 110 of FIG. 6 is identical to the portion 100 of the fuse of FIG. 5, but has additional transverse offset weak spots 116, 118 formed adjacent end sections 122, 124 of fusible portion 110.

Figure 7:
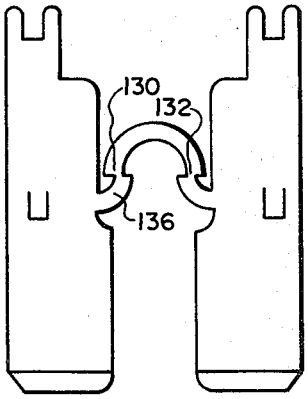
Figure 8:
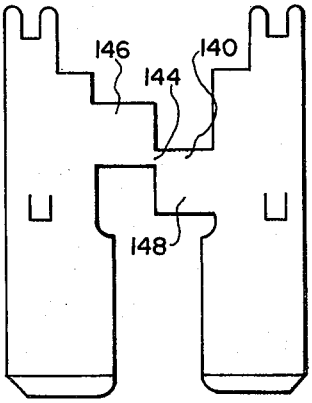

Referring now to FIG. 7, zero-length weak spots 130, 132 are formed in fusible portion 136. The fuse assembly 140 of FIG. 8 shows a zero-length weak spot 144 formed by relatively massive sections 146, 148.

Figure 9:
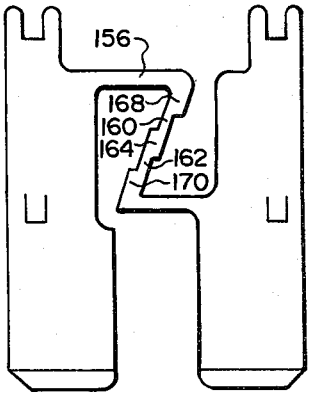

Referring now to FIG. 9, fusible portion 156 is shown having two weak spots 160, 162 comprising web sections of reduced width interconnecting central section 164 with end sections 168, 170, transversely offset therefrom.

The fuse link constructed according to the invention, when applied to low voltage low amperage fuses, offers the same low current ratings as heretofore possible, but does not require skiving as was heretofore required; and, with a minimal amount of skiving, offers lower current ratings than heretofore possible in an integrally formed assembly of plug-in members and fusible portions. Also, the fusible portion of this invention, has a much greater mass throughout its entire length, compared to fusible portions constructed according to prior art techniques. For example, a prior art fuse rated at 3 amperes D.C. was constructed similar to the arrangement thrown in FIG. 3, but without a transverse offset or other weak spot formed therein. Instead, the prior art fusible portion was first skived to a thickness of 0.004 inches, and then blanked to a width of 0.009 inches, both dimensions representing the smallest possible using state-of-the-art commercial processes. A fusible portion constructed according to the invention, as shown in FIG. 4, also rated at three amperes, was skived to a thickness of 0.006 to 0.01 inches and has a uniform width of 0.012 to 0.2 inches throughout its length. Hence, a three ampere fuse constructed according to applicants invention has 1.5 to 3 times greater mass than prior art three ampere fuses. Similar reductions in the amount of skiving, or the elimination of skiving altogether, as well as fusible portions having increased width are realized in fuses constructing according to applicants invention. The increased mass of applicants fuse offers greater rigidity and strength, crucial for withstanding the mechanical shock encountered in automated fabrication. In addition, the increased mass of applicants fuse offers improved cycling characteristics. Further, the fuse link of applicants invention makes possible the inclusion of multiple weak spots along a single fusible portion. Such multiple weak spots could not be provided with prior art fuse constructions. Fuses having multiple weak spots according to applicants invention can include more massive fusible portions in comparison to prior art fuses having one or more weak spots, thereby further improving the mechanical shock and cycling performance of the fuse. By employing the fuse link of applicants invention, fuses having lower ampere ratings than previously available can be formed with a greatly reduced amount of coining or skiving, than was heretofore required. In addition, fuses of ampere ratings comparable to prior art fuses can be formed without costly coining or skiving techniques. Further, less costly punches and dies are required to form the weak spot construction of applicants fuse link. Also, fuses can be more accurately formed, being less susceptible to errors in blanking operations, caused by the misalignment of punches and dies, thereby reducing scrap, and allowing manufacturing tolerances to be held to a greater degree of accuracy using commercially competitive fabrication techniques.

It should be understood that various modifications and variations may be made in the arrangement, operation and details of construction of the elements disclosed herein, without departing from the spirit and scope of this invention.

I claim:

1. In a miniature fuse, an integrally-formed plug-in fuse assembly comprising:

at least two generally parallel elongated spaced-apart conductive legs having first and second ends and lying in a common plane and including at least two plug-in members in said first ends of said conductive legs;

a fusible portion extending between said conductive legs adjacent said second ends, said fusible portion including an elongated strip having a longitudinal axis;

at least one weak spot formed in said strip, said weak spot including first and second portions of said strip, said first and said second portions having predetermined widths and being offset from each other in a direction generally transverse to said longitudinal axis of said strip, such that said weak spot has essentially zero length.

2. The fuse assembly of claim 1 wherein said first and said second portions of said strip include generally straight portions which extend in generally the same direction, and have longitudinal center lines which are generally parallel to each other.

3. The fuse assembly of claim 1 wherein said fusible portion, adjacent said weak spot, is of reduced thickness.

4. The fuse assembly of claim 1 wherein said fusible portion is generally Z-shaped having end portions integrally formed with respective ones of said conductive legs.

5. The fuse assembly of claim 1 wherein said strip is of constant width throughout its length.

6. In a miniature fuse, an integrally formed plug-in fuse assembly comprising at least two generally parallel elongated spaced-apart conductive legs having first and second ends and lying in a common plane and including at least two plug-in members in said first ends of said conductive legs;

a fusible portion extending between said conductive legs adjacent said second ends, said fusible portion including an elongaed strip having a longitudinal axis;

at least one weak spot formed in said strip, said weak spot including first and second portions of said strip, said first and said second portions of said strip each having longitudinal axes and predetermined widths, the longitudinal axes of said first and second portions being offset from each other such that free edges of said first and said second portions are formed at said weak spot, said free edges lying in a common plane oblique to said longitudinal axes of said first and said second portions of said strip.

7. The fuse assembly of claim 6 wherein said first and said second portions of said strip include generally straight line portions which extend in generally the same directions, and have longitudinal center lines which are generally parallel to each other.

8. The fuse assembly of claim 6 wherein said fusible portion, adjacent said weak spot, is of reduced thickness.

9. The fuse assembly of claim 6 wherein said fusible portion is generally Z-shaped having end portions integrally formed with respective ones of said conductive legs.

10. The fuse assembly of claim 6 wherein said strip is of constant width throughout its length.

11. The fuse assembly of claims 1 or 6 wherein said first and said second portions of said strip are of a predetermined width and are offset from each other in a longitudinal direction, a web of reduced width, compared to the width of said first and said second portions, connecting said first and said second portions of said strip.

12. In a miniature fuse, an integrally-formed plug-in fuse assembly comprising at least two generally parallel elongated spaced-apart conductive legs having first and second leg ends and lying in a common plane and including at least two plug-in members in said first leg ends of said conductive legs;

a fusible portion extending between said conductive legs adjacent said second leg ends, said fusible portion including an elongated strip having a longitudinal axis;

at least one weak spot formed in said strip, said weak spot including first and second portions of said strip, said first and second portions having first and second ends respectively, said first and second ends having substantially equal surface areas, substantially equal portions of said first and said second ends joined together to form an offset whereby a weak spot of short effective length is formed in said fusible portion.

13. The fuse assembly of claim 12 wherein said first and said second ends lie in a common plane which is generally perpendicular to the longitudinal axis of said first and said second portions, whereby a weak spot of effectively zero length is formed in said fusible portion.

14. The fuse assembly of claim 12 wherein said first and said second ends lie in a common plane which is oblique to the longitudinal axes of said first and said second portions.

15. The fuse assembly of claims 13 or 14 wherein said first and said second ends are of predetermined widths, and a web of reduced width, compared to the widths of said first and said second ends, connecting said first and said second portions.

* * * * *